US005964174A

United States Patent [19]

Coggan

[11] Patent Number: 5,964,174

[45] Date of Patent: Oct. 12, 1999

[54] ANTI-FOULING PROTECTIVE COVER FOR STERN DRIVE UNIT

[76] Inventor: John C. Coggan, #6-3871 River Rd. West, Delta, British Columbia, Canada, V4K 3N2

[21] Appl. No.: 08/937,822

[22] Filed: Sep. 24, 1997

[51] Int. Cl.[6] ..... B63B 59/04

[52] U.S. Cl. ..... 114/222; 440/113

[58] Field of Search ..... 114/222; 440/113; 150/154, 157

[56] References Cited

U.S. PATENT DOCUMENTS

| | | | |
|---|---|---|---|
| 3,220,374 | 11/1965 | Sloan . | |
| 3,587,508 | 6/1971 | Pearce . | |
| 3,886,889 | 6/1975 | Burger | 114/222 |
| 4,869,695 | 9/1989 | Sajdak, Jr. | 440/88 |
| 4,998,496 | 3/1991 | Shaw, III | 114/222 |
| 5,072,683 | 12/1991 | Colonna | 114/222 |
| 5,315,949 | 5/1994 | Bradley | 114/222 |
| 5,660,136 | 8/1997 | Pignatelli et al. | 150/154 |

*Primary Examiner*—Sherman Basinger
*Attorney, Agent, or Firm*—Dellett and Walters

[57] ABSTRACT

An anti-fouling protective cover prevents marine growth on inboard/outboard or stern drive marine engines. The cover includes first and second side portions, attached to one another along rear, bottom and front portions. The cover is normally urged open by side-stiffening members and transversely-extending members. The cover is conveniently manoeuvred into place onto a stern drive unit with a standard boat hook, and closed by hook and loop fasteners. The cover is constructed of an opaque flexible material such as bonded polyethylene to reduce the amount of light reaching the engine, thereby inhibiting marine growth.

15 Claims, 7 Drawing Sheets

ANTI-FOULING PROTECTIVE COVER FOR STERN DRIVE UNIT

TECHNICAL FIELD

This invention relates to anti-fouling devices for boat engines, and more particularly, to a protective cover for a marine stern drive unit which inhibits marine growth on the unit.

BACKGROUND

In many warmer areas of the world, it is not unusual for boat owners to leave their boats in the water throughout the entire year. This is particularly true in coastal areas. In some cases, such boats are left in the water for years at a time.

A major problem faced by the owners of such boats is the growth of marine organisms (and in particular various plant species) on the outer surfaces of the boat. Submerged surfaces are particularly susceptible to such "fouling". The growth of marine organisms on boat hulls and submerged equipment is highly undesirable, since this fouling causes premature wear of the boats and such equipment, and affects engine and boat performance.

While such fouling is a problem for most boaters, this problem is particularly acute for owners of larger, ocean-going vessels which have inboard/outboard engine units, which are more commonly referred to by boaters as "stern drive units". Such units cannot be tilted up out of the water when not in use, as can smaller outboard engines, and remain submerged unless the boat is removed entirely from the water.

One method which has in the past been used to prohibit this growth of marine organisms on boats is the painting of boat hulls with so-called "anti-fouling paint". Such paints contain various metals such as zinc and work by galvanic action to prevent organism growth. These paints are effective to a certain degree on boat hulls. However, because of their electrolytic action, these paints are not suitable for use on metal surfaces such as those in marine engines.

Various protective engine covers have also been suggested to overcome this problem of marine growth on engines. For example, U.S. Pat. No. 5,315,949, which issued on May 31, 1994 to W. Bradley, discloses a protective cover comprising a large U-shaped frame, which together with a drawstring forms the mouth of a bag for removable installation over a boat motor. U.S. Pat. No. 3,587,508, which issued on Jun. 28, 1971 to J. Pearce, discloses a similar protective flexible bag. U.S. Pat. No. 4,998,496, which issued to H. Shaw on Mar. 12, 1991, discloses a more complicated engine shroud.

All of these prior art suggestions have significant drawbacks which render them unsuitable, or at least impractical, for use on boats with stern drive units. For example, Bradley's device cannot be used with modern stern drive units, which have a much different configuration than the "outcropping" shown in FIG. 1 of the patent. FIG. 1 of the Shaw patent shows the actual configuration of such engines much more accurately. Because of the size of such engines, Bradley's bag cannot be easily manipulated to cover a standard stern drive unit.

Furthermore, Bradley's cover, and that suggested by Pearce have the significant problem that they each lack a frame, beyond their rigid mouth portions, to keep the remainder of the bag portion open to receive the engine when the cover is placed in the water. They are "floppy" when in water, and easily catch and snag on various engine components, making them difficult to install. Often, such snagging causes such bags to tear, rendering them useless.

Another significant drawback of the Bradley cover is that the bag is difficult to open once it has been closed, since the drawstring, which is tightened by pulling a chord through the U-shaped frame, must somehow be pushed back through the frame to loosen the mouth of the bag for removal from the engine. A significantly expensive specialized sheathed cable is required for the mouth of the bag to open and close easily.

Pearce and Shaw both disclose cover units which are more concerned with engine flushing than with the inhibition of marine growth. In both devices there are complicated attachment mechanisms which seal off the interior of the units from the sea water, allowing the interiors to be flushed with fresh water. Such devices, while useful for the preservation of the engine, do not have as their primary purpose the inhibition of marine growth (in fact, Pearce still allows sunlight to penetrate the system), and are accordingly, in view of their complexity, much more costly than necessary for this purpose. Their complexity also makes them difficult to install, routinely, onto a stern drive unit. Furthermore, the Pearce and Shaw devices are bulky and accordingly inconvenient to store on board a boat.

Various other types of boat engine covers are known, but are, like the Shaw device, primarily concerned with systems for flushing engines with fresh water. Examples of such covers are disclosed in the following U.S. patents:

| U.S. Pat. No. | Issue date | Inventor |
|---|---|---|
| 3,220,374 | 30 November, 1965 | Sloan |
| 3,886,889 | 3 June, 1975 | Burger |
| 4,869,695 | 26 September, 1989 | Sajdak, Jr. |
| 5,072,683 | 17 December, 1991 | Colonna |

There remains a significant need for an inexpensive, portable, easily-stored anti-fouling protective cover which can be easily installed onto marine stern drive units using simple tools available to all boaters.

SUMMARY OF INVENTION

The invention provides an anti-fouling protective cover for a stern drive unit, which comprises a bag portion for receiving a stern drive unit; means attached to said bag portion for urging said bag portion into an open position; and means attached to said flexible side portions for forcing said bag portion into a closed position.

In one embodiment of the invention, the cover comprises first and second flexible side portions each having a top edge, a rear edge, a bottom edge, a lower front edge, an upper front edge, and a transverse edge connecting the lower and upper front edges, the side portions attached to one another along the rear, bottom, and a lower front edges; means attached to the flexible side portions for normally urging the cover into an open position; and means attached to the flexible side portions for forcing the cover into a closed position. The cover is preferably made of an essentially opaque material such as a bonded polyethylene.

In one embodiment of the invention, the means for normally urging the cover into an open position comprises one or more pairs of sleeves formed on each of the side portions; a side-stiffening member extending between the pair of the sleeves; a transverse pocket formed on each of the side portions; and at least one pair of transversely-extending stiffening members, one of the pair of members contained within each of the transverse pockets. The transversely-extending stiffening members have a convex curvature when viewed from the outside of the cover. A connector member connects ends of the pair of transversely-extending members at the front edges. Preferably, the side-stiffening members and transversely-extending members are oriented essentially perpendicular one another.

The means for forcing the cover into a closed position comprises a strip of hook and loop fasteners attached to the surface of each of the side portions, along the top edges thereof.

It has been found to be particularly suitable for the side-stiffening members and said transversely-extending members both to comprise sections of non-rigid plastic tubing. In one embodiment of the invention, the ends of this tubing are plugged, thereby trapping air therewithin, adding buoyancy to the cover.

The invention further comprises a rear pocket formed in the cover near the rear edge, a bottom pocket formed in the cover near the bottom edge, and a lower front pocket formed in the cover near the lower front edge, the pockets all containing rods. The rod contained within the bottom pocket is easily removable by hand.

Finally, the invention may comprise upper, lower and intermediate loop portions formed by straps attached to each of the side portions, the upper loop portion occupying a space near the top and rear edges, the lower loop portion occupying a space near the bottom and rear edges and the intermediate loop portion occupying a space near the lower loop portion, the loop portions suitably sized to accept a boat hook. A ring may be linked to intermediate loop portion to ease manipulation of the cover by a boat hook.

BRIEF DESCRIPTION OF DRAWINGS

In drawings which illustrate specific embodiments of the invention, but which should not be construed as restricting the spirit or scope of the invention in any way.

DESCRIPTION

Figure 1:
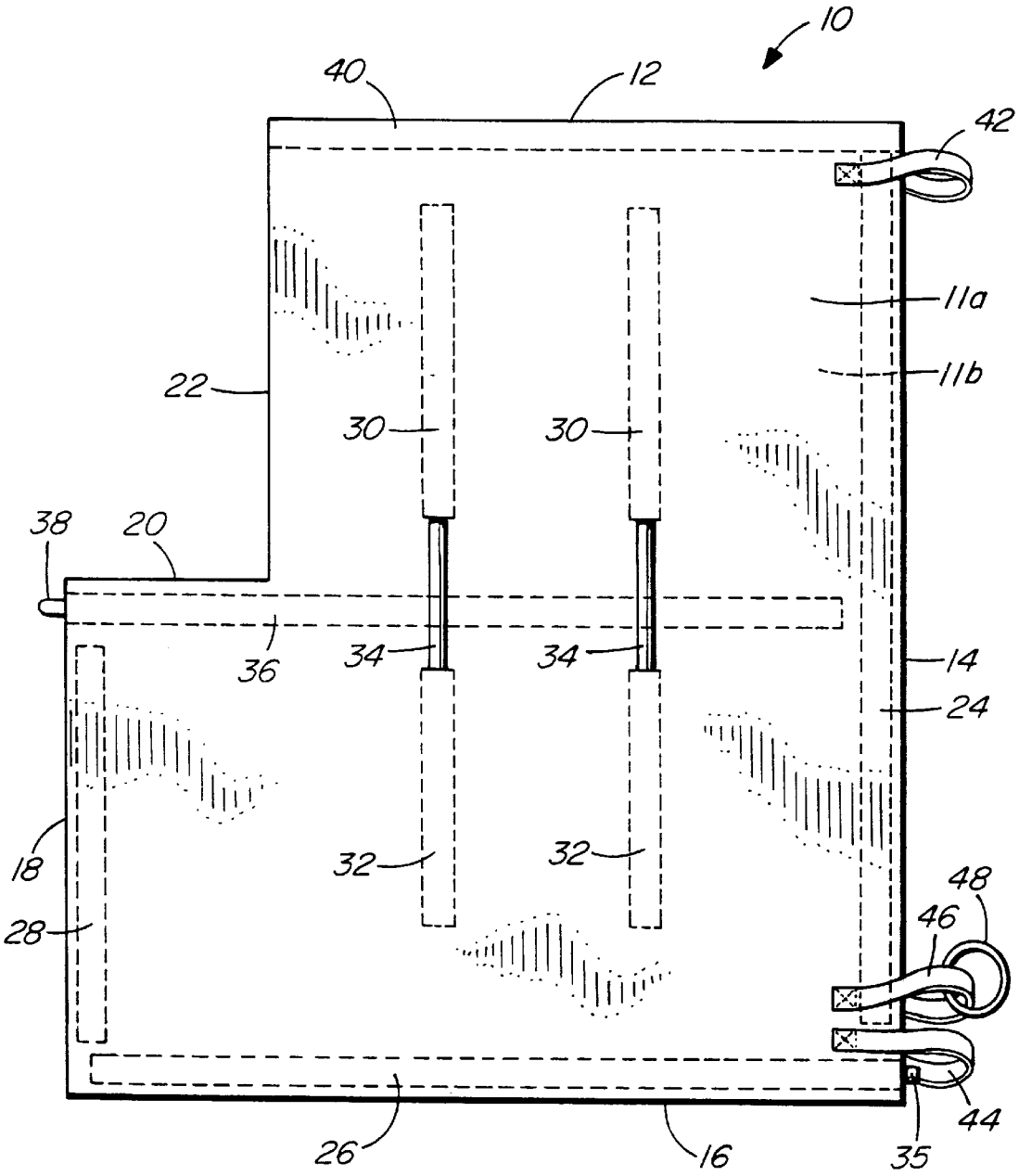
FIG. 1 is a side view of a protective cover made in accordance with one embodiment of the invention, in a closed position.
Figure 4:
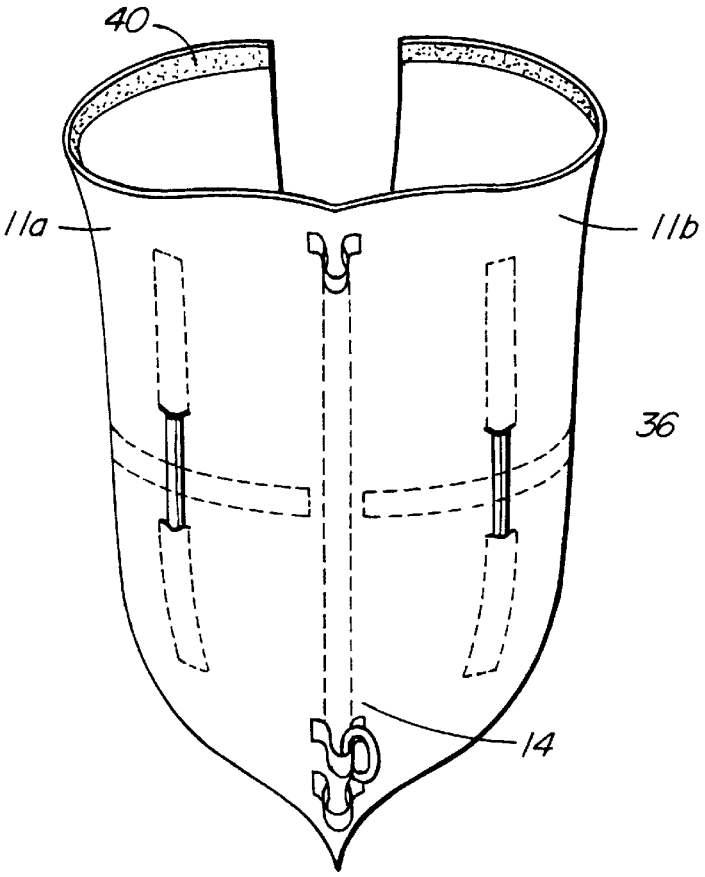
FIG. 4 is a rear view of the cover shown in FIG. 3, with the cover in an open position.

Referring to FIG. 1, a protective cover made in accordance with one embodiment of the invention, denoted generally throughout the drawings by the numeral 10, has first and second side portions 11*a*, 11*b* (side portion 11*b* may be seen in FIG. 4). Side portions 11*a*, 11*b* each have a top edge 12, a rear edge 14, a bottom edge 16, a lower front edge 18, an upper front edge 22, and an intermediate transverse edge 20 connecting lower front edge 18 and upper front edge 22.

Side portions 11*a*, 11*b* are connected to one another along rear edges 14, bottom edges 16 and lower front edges 18, forming a bag-like structure which can be opened along top edges 12, upper front edges 22 and transverse edges 20. Edges 14, 16 and 18 can be attached together in any convenient fashion, although stitching has been found to be a particularly favourable means of attachment.

Side portions 11*a*, 11*b* are preferably made from an essentially opaque flexible material which does not deteriorate quickly in water. Bonded polyethylene has been found to work suitably well.

Cover 10 incorporates a rear pocket 24 adjacent rear edges 14, a bottom pocket 26 adjacent bottom edges 16 and a front pocket 28 adjacent lower front edges 18. As shown in FIG. 1, pockets 24, 26, and 28 preferably run essentially the entire length of rear edges 14, bottom edges 16 and lower front edges 18 respectively. The dotted lines in the drawings show stitching at the edges of the pockets.

Cover 10 also incorporates one or more pairs of upper and lower sleeves 30, 32 on each of side portions 11*a*, 11*b*. A stiffening member such as rod 34 extends between each pair of sleeves 30, 32. As shown in FIG. 1, rod 34 is not enclosed by either of sleeves 30, 32 along some portion of its length, thereby allowing rod 34 to be manipulated by hand. However, rods 34, while rotatable, are preferably not easily removable. Although rod 34 may be made from any suitable material, it has been discovered that rods 34 may favourably comprise sections of non-rigid plastic pipe or tubing.

Rear and front pockets 24, 28 also enclose stiffening members or rods (not shown) similar to rod 34, which extend essentially the entire length of pockets 24, 28. It is preferable that these rods be entirely sealed within pockets 24, 28. On the other hand, pocket 26 preferably contains an easily-removable stiffening member such as bottom rod 35 which is preferably removable from the rear end of bottom pocket 26. It will be appreciated that the removal of bottom rod 35 will allow cover 10 to be rolled up when not in use, even when front pocket 28 and rear pocket 24 contain rods.

Figure 3:
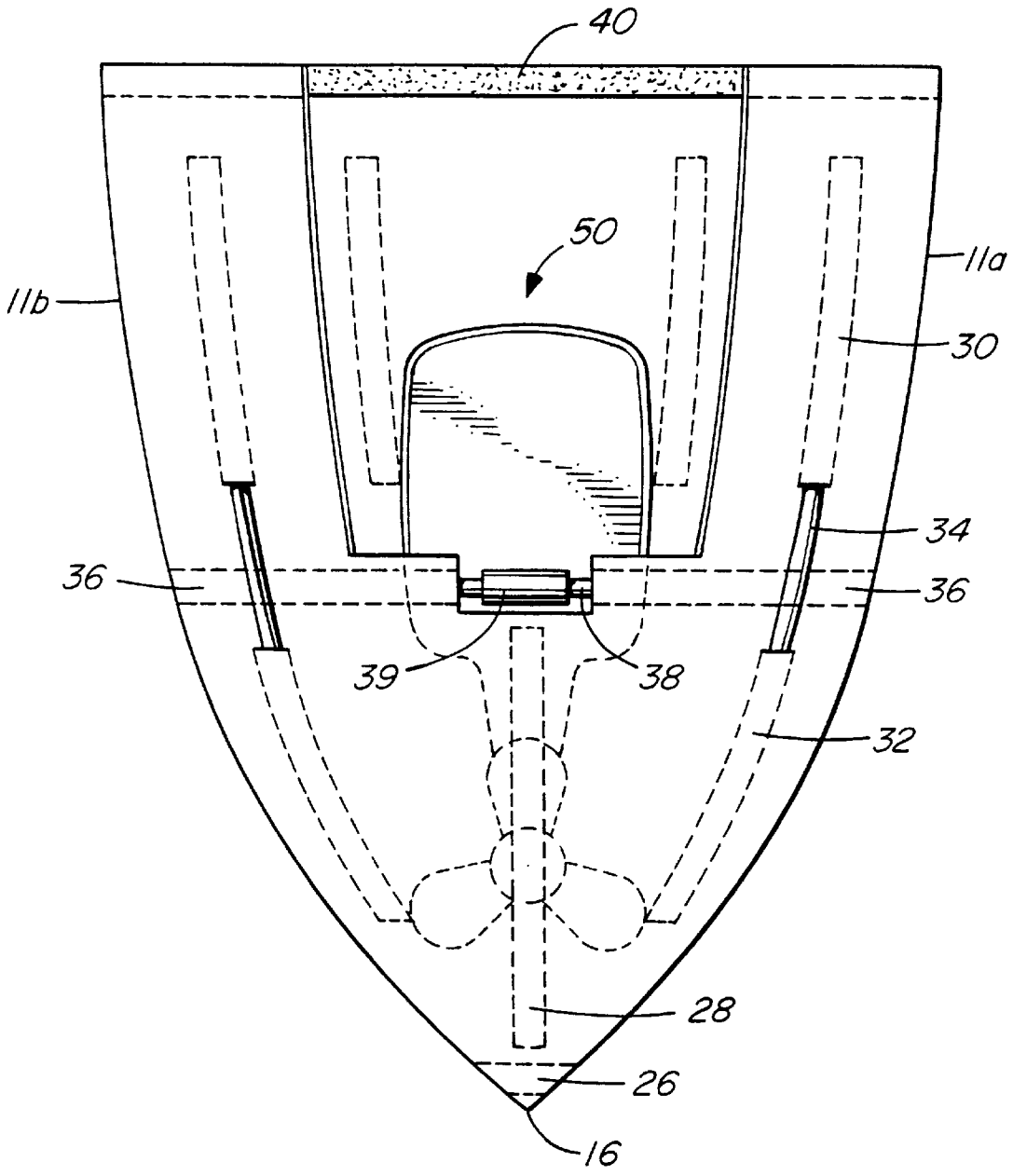
FIG. 3 is a front view of the cover shown in FIG. 2, with the cover in an open position, covering the stern drive, looking back from the transom of a boat.
Figure 6:
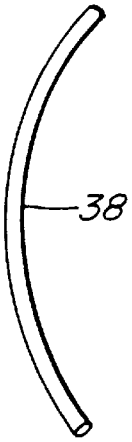
FIG. 6 is a view of a curved transverse stiffening member of the invention.
Figure 7:
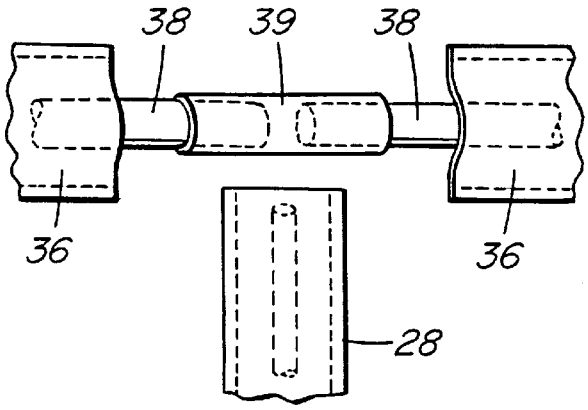
FIG. 7 is a fragmentary view of the connector connecting two curved transverse stiffening members of the invention.
Figure 8:
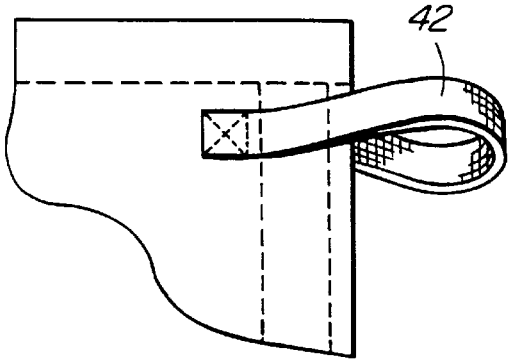
FIG. 8 is a side view of the loop formed by the upper strap of the cover shown in FIG. 1.
Figure 9:
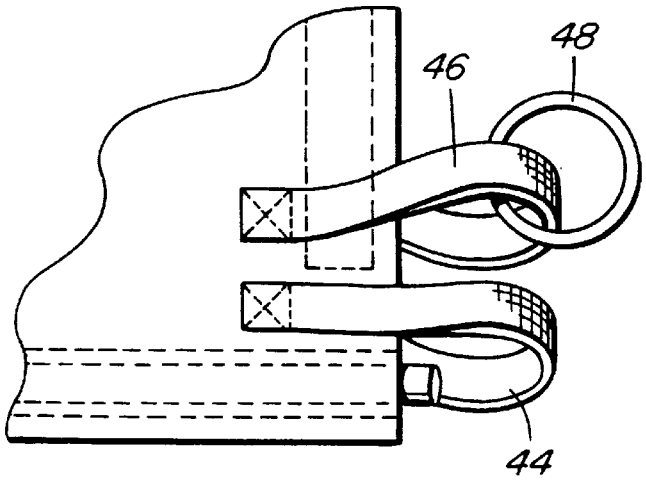
FIG. 9 is a side view of the intermediate and lower strap loops of the cover shown in FIG. 1.

In a preferred embodiment of the invention, each of the side portions 11*a*, 11*b* also incorporates a transverse pocket 36 intermediate top and bottom edges 12, 16 which runs adjacent transverse edge 20 from lower front edge 18 to near rear edge 14. Transverse pockets 36 accept transverse stiffening members such as curved rods 38 (shown in detail in FIG. 6). Curved rods 38 may also be formed of suitable plastic tubing. Although a single U-shaped curved rod may be used (with one end inserted into each of transverse pockets 36), it is preferable to employ two curved rods 38, connected by a connector 39, as shown in FIGS. 3 and 7. This allows for more convenient storage of curved rods 38 when cover 10 is not in use. In fact, curved rods 38 may be neatly rolled up in the middle of cover 10, along with rods 34, when cover 10 is rolled up for storage.

As shown in FIGS. 3 and 4, a strip of hook and loop fasteners 40 such as those sold under the trade name "Velcro" is attached to the inside surfaces of side portions 11*a*, 11*b*, running along the top edges 12 of portions 11*a*, 11*b*.

Figure 2:
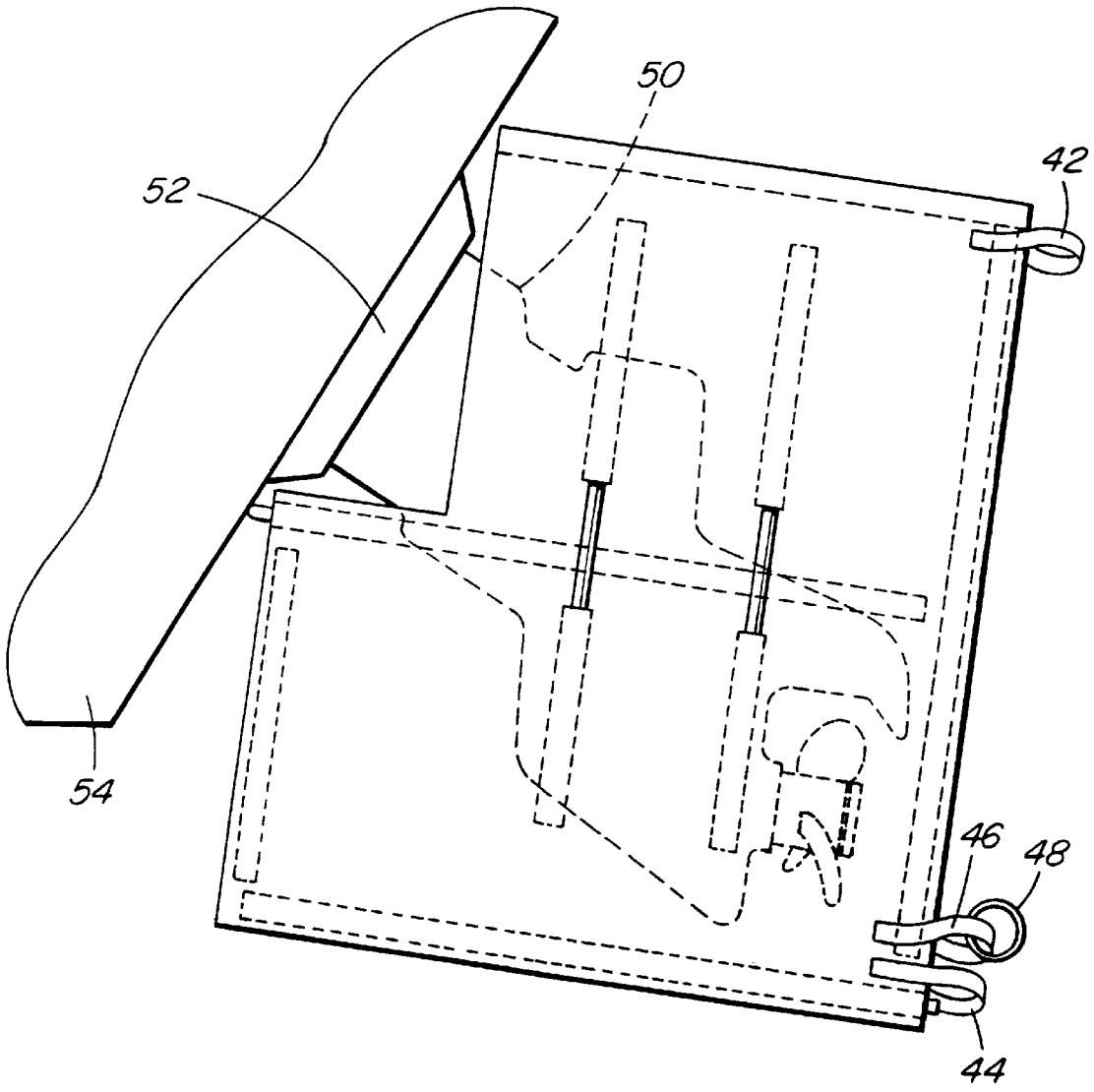
FIG. 2 is a side view of the protective cover shown in FIG. 1, installed and covering the stern drive unit of a boat (which is shown in dotted outline)

On many larger boats 54 (FIG. 2), a stern drive unit 50 is typically attached to a transom 52 on the stern of boat 54.

When installing cover 10 onto stern drive unit 50, cover 10, which may have conveniently been rolled up and stored aboard boat 54, is unrolled. Bottom rod 35 is inserted into bottom pocket 26. A curved rod 38 is inserted into each transverse pocket 36, and connector 39 connects the ends of curved rods 38 (as shown in FIG. 7), at the lower front edges 18 of cover 10.

It will be appreciated that rods 34 prevent side portions 11*a,* 11*b* from collapsing onto themselves when cover 10 is placed in water. When properly inserted into transverse pockets 36, curved rods 38 have a convex curvature when viewed from the outside of cover 10. It will further be appreciated that cover 10 is normally urged into an open position when rods 34 and curved rods 38 are inserted.

Boats which have stern drive units very commonly have one or more boat hooks on board. With cover 10 in an open position, a typical boat hook 56 (FIG. 10), which has an end portion comprising a metal hook portion 58 and a lower prong portion 60, may be inserted through an upper loop portion 42 formed by a strap attached to both of side portions 11*a,* 11*b* near the top and rear edges thereof. A similar lower loop 44 is formed by strap attached near the bottom and rear edges of side portions 11*a,* 11*b*. An intermediate loop 46 formed by a third strap occupies a position near lower loop 44. A ring 48 is linked to intermediate loop 46.

Figure 10:
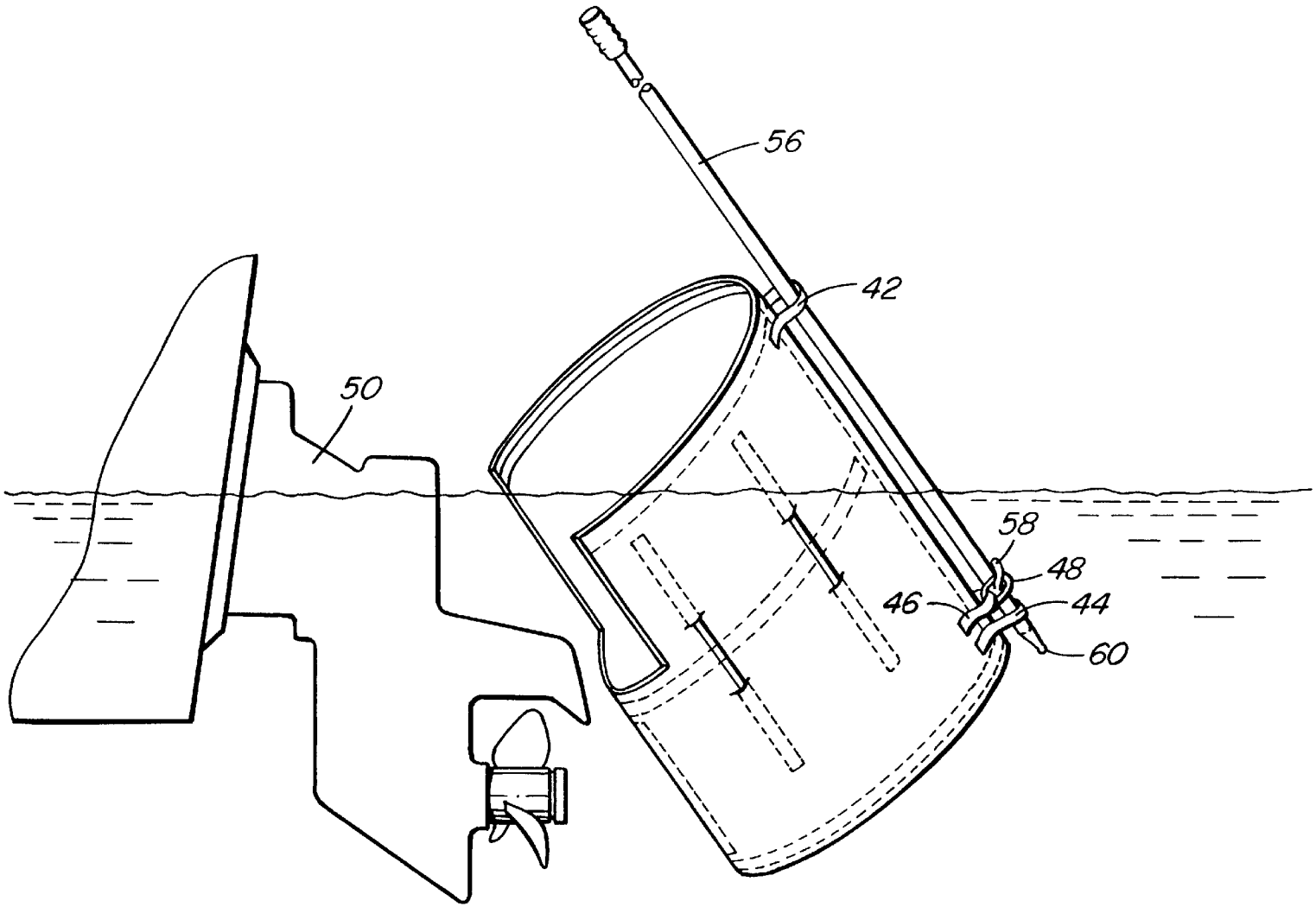
FIG. 10 is a side view of the cover being placed into position on a stern drive unit with a typical boat hook.
Figure 11:
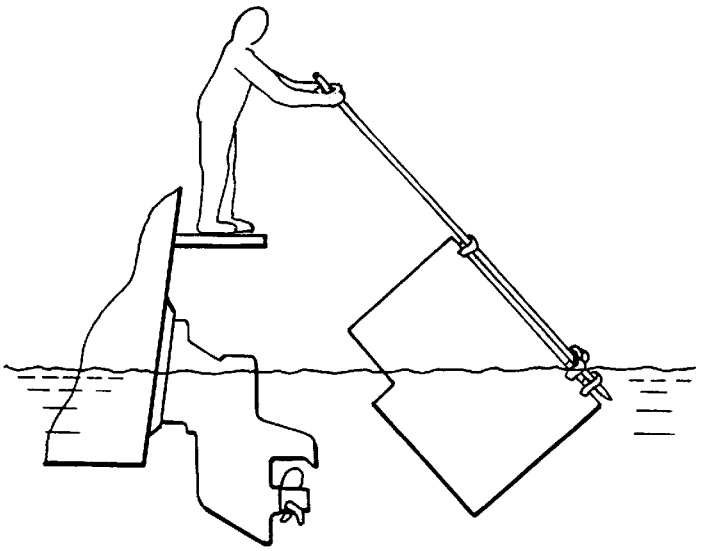
FIGS. 11, 12 and 13 show schematically the cover being placed into position on a stern drive unit in a series of steps.
Figure 12:
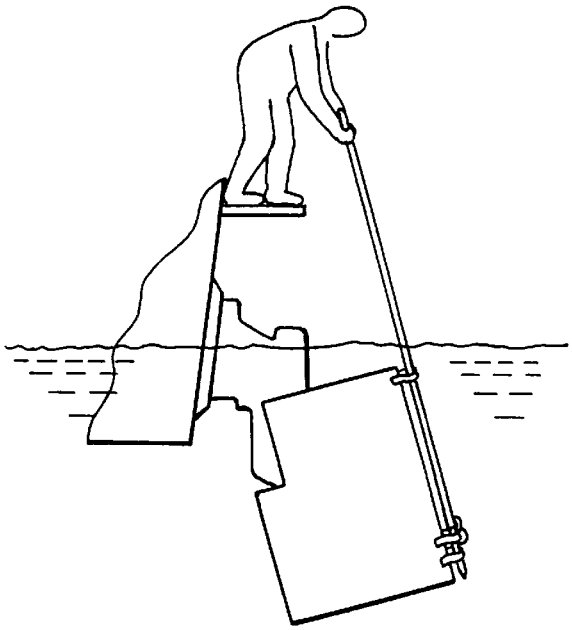

When installing cover 10, boat hook 56 is first inserted through loops 42, 44, and 46, as shown in FIG. 11. Boat hook 56 is manipulated in a manner familiar to boaters such that prong portion 60 thereof engages lower loop 44, and hook portion 58 thereof engages ring 48, as shown in FIG. 10. As boaters will appreciate, once boat hook 56 engages cover 10 in this fashion, cover 10 is easily manoeuvred behind and below stern drive unit 50. Cover 10, which is in an open position, is then drawn upwards and towards the stern of boat 54, enclosing stern drive unit 50, as shown in FIG. 12.

It will be appreciated that while transverse edges 20 do not necessarily need to be long, the greater the length of transverse edges 20, the easier it will be to install cover 10 onto stern drive unit 50. However, if transverse edges 20 are too long, too much light is allowed to pass into cover 10 even when closed.

Figure 5:
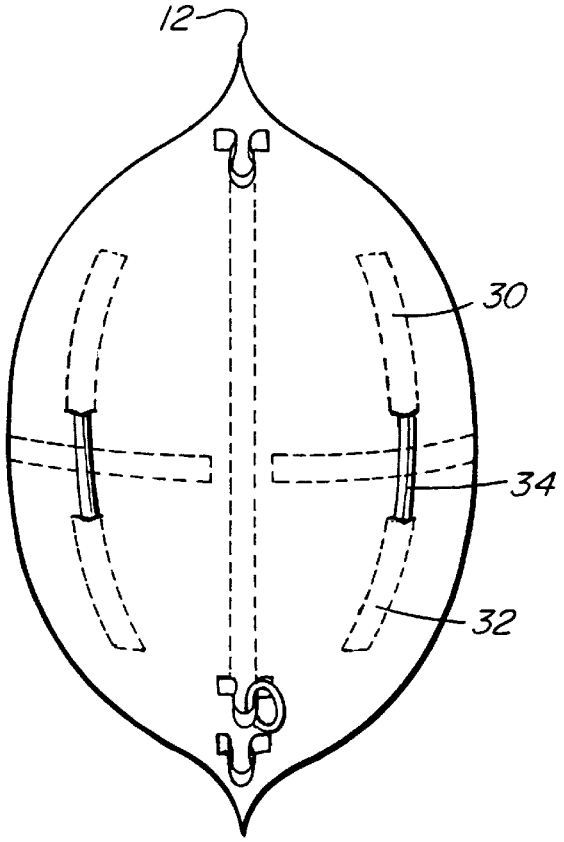
FIG. 5 is a rear view of the cover shown in FIG. 4, with the cover in a closed position.
Figure 13:
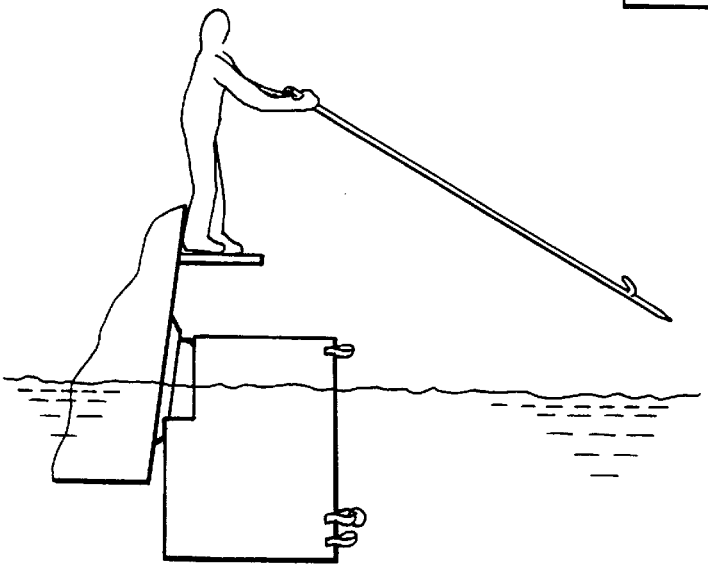

Once in place around stern drive unit 50, cover 10, which as described above is in an open position, is closed by pressing together top edges 12 of side portions 11*a,* 11*b,* causing hook and loop fasteners 40 to engage one another. FIG. 5 shows cover 10 in a closed position. Of course, a wide enough strip of fasteners must be used to overcome the force provided by rods 34 and 38 which normally urges cover 10 into an open position. Boat hook 56 may be removed from cover 10 before or after cover 10 is closed, as shown in FIG. 13.

It will be appreciated that the greater the stiffness of rods 34 and 38, the greater will be the urging force provided to keep cover 10 normally in an open position. Preferably, rods 34 and 38 should be stiff enough to maintain cover 10 open even when cover 10 is placed in the water, but not so stiff that the strip of fasteners 40 is required to have a width of more than a few inches to overcome the opening force generated by the rods 34, 38 and keep cover 10 closed.

To remove cover 20 from stern drive unit 50, top edges 12 are pulled apart, boat hook 56 is inserted through loops 42, 44 and 46 and manipulated to engage loop 44 and ring 48. Cover 10 can then easily be manoeuvred down and away from stern drive unit 50 and boat 54. As described previously, cover 10 can then be taken out of the water and rolled up for convenient storage on board boat 54.

As will be appreciated, if rods 34 comprise sections of plastic tubing, they will have a "memory" which will cause them to adopt a certain convex curvature over time, thereby losing their effectiveness. The benefit of sleeves 30, 32 not covering rods 34 entirely is that a rod 34 which has become curved can simply be rotated 180 degrees by hand to reverse its curvature.

It has been found that many types of materials from which side portions 11*a,* 11*b* might be made do not have enough buoyancy to keep cover 10 from sinking when placed in water. To add buoyancy conveniently to cover 10, the ends of all plastic-tubing rods used in cover 10 may be plugged with a suitable material, thereby trapping air within the rods.

As will be apparent to those skilled in the art in the light of the foregoing disclosure, many alterations and modifications are possible in the practice of this invention without departing from the spirit or scope thereof. For instance, some or all of the stiffening rods employed in the invention may be comprised not of sections of plastic tubing, but rather, of fibreglass rods. Accordingly, the scope of the invention is to be construed in accordance with the substance defined by the following claims.

What is claimed is:

1. An anti-fouling protective cover for a stern drive unit, comprising:

a) first and second flexible side portions each having a top edge, a rear edge, a bottom edge, a lower front edge, an upper front edge, and a transverse edge connecting said lower and upper front edges, said side portions attached to one another along said rear, bottom, and a lower front edges;

b) means attached to said flexible side portions for forcing said cover into a closed position; and c) means for normally urging said cover into an open position, said means comprising:

i) one or more pairs of sleeves formed on each of said side portions;

ii) a side-stiffening member extending between said pair of said sleeves;

iii) a transverse pocket formed on each of said side portions; and iv) at least one pair of transversely-extending stiffening members, one of said pair of members contained within each of said transverse pockets.

2. The protective cover as claimed in claim 1 wherein said transversely-extending stiffening members have a convex curvature when viewed from the outside of said cover.

3. The protective cover as claimed in claim 2 wherein a connector member connects ends of said pair of transversely-extending members.

4. The protective cover as claimed in claim 3 wherein said side-stiffening members and transversely-extending members are oriented essentially perpendicular one another.

5. The protective cover as claimed in claim 4 further comprising a rear pocket formed in said cover near said rear edge, a bottom pocket formed in said cover near said bottom edge, and a lower front pocket formed in said cover near said lower front edge, said pockets containing rods.

6. The protective cover as claimed in claim 5 wherein said rod contained within said bottom pocket is easily removable by hand.

7. The protective cover as claimed in claim 6 wherein said means for forcing said cover into a closed position comprises a strip of hook and loop fasteners attached to the surface of each of said side portions, along said top edges thereof.

8. The protective cover as claimed in claim 7 further comprising upper, lower and intermediate loop portions formed by straps attached to each of said side portions, said upper loop portion occupying a space near said top and rear edges, said lower loop portion occupying a space near said bottom and rear edges and said intermediate loop portion occupying a space near said lower loop portion, said loop portions suitably sized to accept a boat hook.

9. The protective cover as claimed in claim 8 wherein a ring member is linked to said intermediate loop portion.

10. The protective cover as claimed in claim 9 wherein said ring is configured to accept the hook portion of said boat hook.

11. The protective cover as claimed in claim 10 wherein said side portions made of an essentially opaque material.

12. The protective cover as claimed in claim 11 wherein said material is a bonded polyethylene.

13. The protective cover as claimed in claim 12 wherein said side-stiffening members and said transversely-extending members both comprise sections of non-rigid plastic tubing.

14. The protective cover as claimed in claim 13 wherein the ends of said side-stiffening members and said transversely-extending members are plugged, thereby trapping air therewithin.

15. The protective cover as claimed in claim 12 wherein said side-stiffening members and said transversely-extending members both comprise fibreglass rods.

* * * * *